US012252867B1

(12) United States Patent
Huang et al.

(10) Patent No.: US 12,252,867 B1
(45) Date of Patent: Mar. 18, 2025

(54) METHOD AND APPARATUS FOR CONTROLLING WHEEL LOADER, AND WHEEL LOADER AND STORAGE MEDIUM

(71) Applicant: SUOTE TRANSMISSION EQUIPMENT CO., LTD., Jiangsu (CN)

(72) Inventors: Liang Huang, Jiangsu (CN); Fuwen Li, Jiangsu (CN); Zhenbei Zhang, Jiangsu (CN)

(73) Assignee: SUOTE TRANSMISSION EQUIPMENT CO., LTD., Jiangsu (CN)

( * ) Notice: Subject to any disclaimer, the term of this patent is extended or adjusted under 35 U.S.C. 154(b) by 0 days.

(21) Appl. No.: 18/011,281

(22) PCT Filed: Dec. 27, 2021

(86) PCT No.: PCT/CN2021/141809
§ 371 (c)(1),
(2) Date: Dec. 19, 2022

(87) PCT Pub. No.: WO2022/179286
PCT Pub. Date: Sep. 1, 2022

(30) Foreign Application Priority Data

Feb. 24, 2021 (CN) ..... 202110207945.0

(51) Int. Cl.
*E02F 9/22* (2006.01)
*E02F 9/20* (2006.01)

(52) U.S. Cl.
CPC ..... *E02F 9/2253* (2013.01); *E02F 9/2037* (2013.01); *E02F 9/2062* (2013.01)

(58) Field of Classification Search
None
See application file for complete search history.

(56) References Cited

U.S. PATENT DOCUMENTS 5,116,187 A 5/1992 Fukuda et al.
2010/0131122 A1* 5/2010 Dersjo ..... E02F 9/2253 701/2

(Continued)

FOREIGN PATENT DOCUMENTS

CN 105003643 A 10/2015
CN 110206090 A 9/2019

(Continued)

OTHER PUBLICATIONS

Machine Translation of KR 20160133320 (Year: 2016).*

(Continued)

*Primary Examiner* — James J Lee
*Assistant Examiner* — David Hatch
(74) *Attorney, Agent, or Firm* — Womble Bond Dickinson (US) LLP

(57) ABSTRACT

Disclosed in the present application are a method and apparatus for controlling a wheel loader, and a wheel loader and a storage medium, wherein an original trigger condition for KickDown is preset in the wheel loader. The method for controlling a wheel loader comprises: acquiring a way for releasing KickDown of a wheel loader; determining the current state of the wheel loader on the basis of the way for releasing KickDown; and when the current state of the wheel loader is working state, adjusting an original trigger condition to a first trigger condition, wherein the first trigger condition is easier to trigger than the original trigger condition.

8 Claims, 4 Drawing Sheets

(56) References Cited

U.S. PATENT DOCUMENTS

| | | | | |
|---|---|---|---|---|
| 2016/0167647 | A1* | 6/2016 | Yamada | B60W 10/10<br>701/50 |
| 2018/0230677 | A1* | 8/2018 | Becker | E02F 9/2235 |

FOREIGN PATENT DOCUMENTS

| | | | |
|---|---|---|---|
| CN | 12982538 | A | 6/2021 |
| CN | 111828611 | A | 7/2021 |
| KR | 20160061061 | A | 5/2016 |

OTHER PUBLICATIONS

Machine Translation of KR 20160133327 (Year: 2016).*
First Office Action CN2021102079450.
First Search of Priority CN2021102079450.
Supplementary Search Report of Priority CN2021102079450.
International Search Report received in related International Application No. PCT/CN2021/141809, mailed Mar. 25, 2022, 4 pages.

* cited by examiner

METHOD AND APPARATUS FOR CONTROLLING WHEEL LOADER, AND WHEEL LOADER AND STORAGE MEDIUM

CROSS-REFERENCE RELATED APPLICATIONS

The present application is the National Phase of International Application No. PCT/CN2021/141809 filed on Dec. 27, 2021, which claims priority to the benefit of Chinese Patent Application no. 202110207945.0 filed Feb. 24, 2021, and the disclosures of which are hereby incorporated herein by reference in their entireties.

TECHNICAL FIELD

The present application relates to the technical field of construction machinery control, in particular to a method and a device for controlling a wheel loader, a wheel loader and a storage medium.

BACKGROUND

At present, there are two power outputs of wheel loader equipped with auto transmission. One output is a hydraulic driving force for the bucket, where an engine drives a hydraulic pump to form a driving oil pressure. The other output is a driving force for the loader, which is output to the wheel end through a hydraulic torque converter and a transmission. When the wheel loader equipped with auto transmission is working, it needs to frequently load/unload materials, upshift/downshift and switch between front and rear directions due to the particularity of its operating mode. When a vehicle is normally driven, the power is allocated to the wheel end through the transmission. When the loader load materials by the bucket, the driving power allocated to the vehicle should be reduced as much as possible and the power allocated to the bucket should be increased because the vehicle is generally stopped at this time. Therefore, when the loader is loading materials, the gear of the transmission should be shift to the $1^{st}$ gear quickly, namely the KickDown function, to reduce the driving power allocated to the vehicle, and the power allocated to the bucket may be increased under the same power of the engine. The typical working condition is to shift to $2^{nd}$ gear, and then the loader is driven to the front of the material quickly in the direction of forward, after braking to slow down, the bucket is put lower and flat to load the material, and at this time, when the accelerator is pressed hard to make the bucket load materials, a KickDown 2-1 downshift should be triggered to reduce the power allocated to the output of the transmission and increase the power allocated to the bucket. For a transmission that supports manual KickDown, a driver can manually operate to realize a quick KickDown downshifting. For an auto transmission, the automatic KickDown function should be added. At present, the triggering of automatic KickDown is basically determined according to a transmission load, an engine speed, an accelerator opening, etc.

U.S. Pat. No. 9,085,294B2 discloses a strategy to trigger KickDown in advance through the bucket position of a loader, a transmission load, a vehicle speed, an engine speed, etc. However, U.S. Pat. No. 9,085,294B2 has the following defects: 1) a bucket position sensor must be provided, but many loaders do not have a bucket position sensor at present; and 2) a slope sensor or an acceleration sensor must be provided to calculate the transmission load, but many loaders are not equipped with a slope sensor or an acceleration sensor at present. That is to say, the solutions of U.S. Pat. No. 9,085,294B2 need to install the bucket position sensor and the slope sensor, or to install the bucket position sensor and the acceleration sensor, which is costly.

SUMMARY

In view of this, embodiments of the present application provide a method and a device for controlling a wheel loader, a wheel loader and a storage medium to solve the problem of high cost of triggering KickDown in advance.

According to a first aspect, the embodiment of the present application provides a method for controlling a wheel loader, where an original trigger condition of KickDown is preset in the wheel loader is preset with, and the method includes:

- obtaining a release way of KickDown of the wheel loader;
- determining a current state of the wheel loader based on the release way of KickDown; and
- adjusting the original trigger condition to a first trigger condition when the current state of the wheel loader is working state, where the first trigger condition is easier to be triggered than the original trigger condition.

In the method for controlling the wheel loader provided by the embodiment of the present application, by obtaining the release way of KickDown, determining the current state of the wheel loader according to the release way of KickDown, and then adjusting the original trigger condition of KickDown when the current state of the wheel loader is working state, KickDown can be triggered in advance, and the wheel loader does not need to be provided the bucket position sensor and the slope sensor, or the bucket position sensor and acceleration sensor, which causes a lower cost and a wide applicability.

In view of the first aspect, in a first embodiment of the first aspect, the method for controlling the wheel loader further includes: adjusting the original trigger condition to a second trigger condition when the current state of the wheel loader is a traveling state, where the second trigger condition is harder to be triggered than the original trigger condition. Thus, it may make KickDown harder to be triggered by adjusting the original trigger condition of KickDown in the operating mode, so as to avoid false triggering.

In view of the first aspect, in a second embodiment of the first aspect, the original trigger condition includes one or more trigger sub-conditions, and each trigger sub-condition has a corresponding trigger threshold; the adjusting the original trigger condition to a first trigger condition includes: adjusting one or more trigger thresholds by a corresponding first adjustment amount.

In view of the first aspect, in a third embodiment of the first aspect, the original trigger condition includes one or more trigger sub-conditions, and each trigger sub-condition has a corresponding trigger threshold; the adjusting the original trigger condition to a second trigger condition includes: adjusting one or more trigger thresholds by a corresponding second adjustment amount.

In view of the first aspect, in a fourth embodiment of the first aspect, the determining a current state of the wheel loader based on the release way of KickDown includes:

- determining that the current state of the wheel loader is working state when the current release way of KickDown is to switch a traveling direction of the wheel loader; or
- determining that the current state of the wheel loader is working state when multiple continuous release ways of KickDown are to switch the traveling direction of the wheel loader.

In view of the first aspect, in a fifth embodiment of the first aspect, the determining a current state of the wheel loader based on the release way of KickDown includes:

determining that the current state of the wheel loader is traveling state when the current release way of KickDown is natural upshifting; or sequentially determining whether all vehicle speeds of the wheel loader belong to a preset first range during a preset first duration when the current release way of KickDown is natural upshifting, and determining that the current state of the wheel loader is traveling state when all the vehicle speeds of the wheel loader belong to the preset first range during the preset first duration.

In view of the first aspect, in a sixth embodiment of the first aspect, after the adjusting the original trigger condition to a first trigger condition, the method further includes:

sequentially obtaining the release way of KickDown;

maintaining the first trigger condition when the release way of KickDown is to switch the traveling direction of the wheel loader; and adjusting the first trigger condition to the original trigger condition when the release way of KickDown is natural upshifting.

In view of the first aspect, in a seventh embodiment of the first aspect, after the adjusting the original trigger condition to a second trigger condition, the method further includes:

determining whether KickDown is triggered; and adjusting the second trigger condition to the original trigger condition when KickDown is triggered.

According to a second aspect, the embodiment of the present application provides a device for controlling a wheel loader, where an original trigger condition of KickDown is preset in the wheel loader, and the device includes:

an obtaining module, used to obtain a release way of KickDown of a wheel loader;

a state determination module, used to determine a current state of the wheel loader based on the release way of KickDown; and an adjustment module, used to adjust the original trigger condition to a first trigger condition when the current state of the wheel loader is working state, where the first trigger condition is easier to be triggered than the original trigger condition.

According to a third aspect, the embodiment of the present application provides a wheel loader, including a processor and a memory which are communicated with each other; the memory stores computer instructions and the processor executes the computer instructions to perform the method for controlling the wheel loader of the first aspect or any embodiment of the first aspect.

According to a fourth aspect, the embodiment of the present application provides a computer-readable storage medium storing computer instructions for enabling the computer to execute the method for controlling the wheel loader of the first aspect or any embodiment of the first aspect.

BRIEF DESCRIPTION OF DRAWINGS

The features and advantages of the present application will be more clearly illustrated by referring to the drawings. The drawings are schematic and should not be understood as any restriction on the present application.

DETAILED DESCRIPTION OF THE EMBODIMENTS

In order to make the objectives, solutions and advantages of the embodiments of the present application more clear, the solutions according to the embodiments of the present application will be described clearly and completely below in conjunction with the accompanying drawings in the embodiments of the present application. It should be noted that the embodiments described are some of the embodiments of the present application rather than all the embodiments. Based on the embodiments of the present application, all other embodiments obtained by those of ordinary skill in the art without making creative effort fall within the scope of protection of the application.

Embodiment 1

Figure 1:
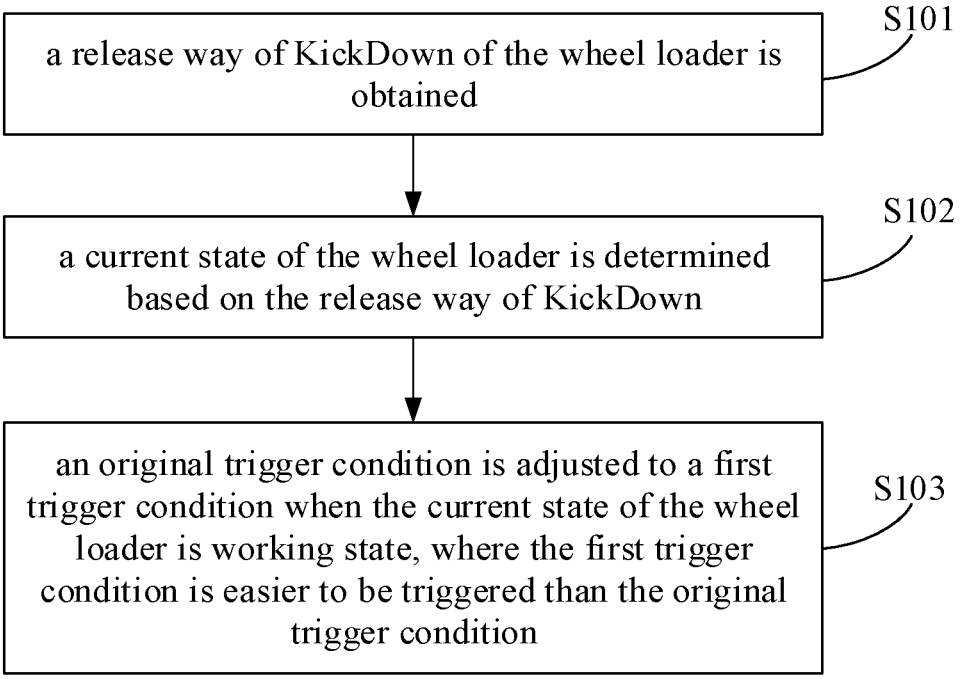
FIG. 1 is a flow diagram of a method for controlling a wheel loader according to an embodiment 1 of the present application.

Embodiment 1 of the present application provides a method for controlling a wheel loader. FIG. 1 is a flow diagram of the method for controlling the wheel loader according to the embodiment 1 of the present application. As shown in FIG. 1, the method for controlling a wheel loader in the embodiment 1 of the present application includes the following steps.

S101: a release way of KickDown of the wheel loader is obtained.

S102: a current state of the wheel loader is determined based on the release way of KickDown.

According to working characteristics of the wheel loader, a KickDown downshifting will be triggered when the wheel loader is loading materials under a working condition of loading/unloading materials and the KickDown downshifting will be released by switching the traveling direction of the wheel loader to return to the former gear. If KickDown is triggered when the loader is in traveling state, the KickDown is most likely to be released by increasing the vehicle speed, for example, by a natural upshifting.

It should be noted that, in the embodiment 1 of the present application, the KickDown can be either automatically triggered or manually triggered by the driver clicks a KickDown button.

Based on these, as an embodiment, the following two solutions can be used to determine the current state of the wheel loader based on the release way of KickDown.

In the first solution, it is determined that the current state of the wheel loader is working state when the current release way of KickDown is to switch the traveling direction of the wheel loader. For example, when one release way of KickDown is to switch the traveling direction of the wheel loader, it can be determined that the current state of the wheel loader is working state, such as a state of loading/unloading materials.

In the second solution, it is determined that the current state of the wheel loader is working state when multiple continuous release ways of KickDown are to switch the traveling direction of the wheel loader. For example, it is determined that the current state of the wheel loader is working state only when multiple continuous release ways of KickDown are to switch the traveling direction of the wheel loader, which makes the determination of the current state of the wheel loader more accurate. It should be noted that, it can not be determined that the current state of the wheel loader is working state as long as one of the continuous release ways is not to switch the traveling direction of the wheel loader. In an embodiment, multiple continuous release ways may be two continuous release ways.

In an embodiment, the following two solutions can be used to determine the current state of the wheel loader based on the release way of KickDown.

In the first solution, it is determined that the current state of the wheel loader is a traveling state when the current release way of KickDown is natural upshifting. For example, it can be determined that the current state of the wheel loader is the traveling state when one release way of KickDown is natural upshifting.

In the second solution, it is determined whether all vehicle speeds of the wheel loader belong to a preset first range during a preset first duration when the current release way of KickDown is natural upshifting, and it is determined that the current state of the wheel loader is the traveling state when all the vehicle speeds of the wheel loader belong to the preset first range during the preset first duration. For example, it can not be determined directly whether the current state of the wheel loader is the traveling state when one release way of KickDown is natural upshifting, and it is also necessary to determine whether all the vehicle speeds of the wheel loader belong to the preset first range during the preset first duration. If not, it is not possible to determine that the current state of the wheel loader is the traveling state, which makes the determination of the current state of the wheel loader more accurate.

S103: an original trigger condition is adjusted to a first trigger condition when the current state of the wheel loader is working state, where the first trigger condition is easier to be triggered than the original trigger condition; and the original trigger condition is adjusted to a second trigger condition when the current state of the wheel loader is traveling state, where the second trigger condition is harder to be triggered than the original trigger condition.

In an embodiment, trigger thresholds of engine speed, vehicle speed, accelerator pedal, etc. can be set as trigger conditions of KickDown. For example, KickDown can be triggered when the engine speed is greater than a preset first trigger threshold.

In the embodiments of the present application, the original trigger condition includes one or more trigger sub-conditions, and each trigger sub-condition has a corresponding trigger threshold. In an embodiment, the following solutions can be used to adjust the original trigger condition to the first trigger condition: one or more trigger thresholds are adjusted by the corresponding first adjustment amount, to make KickDown be easier to be triggered. For example, the first adjustment amount should be subtracted from the trigger threshold when the trigger sub-condition is that a certain parameter is greater than the trigger threshold; and the trigger threshold should be added by the first adjustment amount when the trigger sub-condition is that a certain parameter is less than the trigger threshold. It should be noted that the first adjustment amounts for adjusting respective trigger thresholds can be the same or different.

As an optional embodiment, after the original trigger condition is adjusted to the first trigger condition, the method also includes: the release way of KickDown is continuously obtained; the first trigger condition is maintained when the release way of KickDown is to switch the traveling direction of the wheel loader; and the first trigger condition is adjusted to the original trigger condition when the release way of KickDown is natural upshifting.

As another optional embodiment, after the original trigger condition is adjusted to the first trigger condition, the method also includes: the first trigger condition is adjusted to the original trigger condition when the wheel loader is powered off.

In the method for controlling the wheel loader provided by the embodiment 1 of the present application, by obtaining the release way of KickDown, determining the current state of the wheel loader according to the release way of KickDown, and then adjusting the original trigger condition of KickDown when the current state of the wheel loader is working state, KickDown can be triggered in advance, and the wheel loader does not need to be provided the bucket position sensor and the slope sensor, or the bucket position sensor and acceleration sensor, which causes a lower cost and a wide applicability.

In the embodiment 1 of the present application, by determining that the loader is in operating mode, KickDown can be triggered in advance to perform 2-1 downshift when it is needed to load materials to increase the input shaft speed (also the turbine speed of the hydraulic torque converter) of the transmission. The torque ratio of the hydraulic torque converter will decrease when the speed ratio of the hydraulic torque converter decreases, and then the power allocated by the engine to the auto transmission will decrease and the corresponding power allocated to the bucket hydraulic pump motor will increase. In this way, the loading power for the bucket can be increased without increasing the engine output, which effectively improves the output efficiency of the engine and reduces fuel consumption.

S104: the original trigger condition is adjusted to the second trigger condition when the current state of the wheel loader is traveling state, where the second trigger condition is harder to be triggered than the original trigger condition.

In an embodiment, the original trigger condition includes one or more trigger sub-conditions. In an embodiment, the following solutions can be used to adjust the original trigger condition to the second trigger condition: one or more trigger thresholds are added by a corresponding second adjustment amount to make KickDown be harder to be triggered to avoid a false triggering. For example, the trigger threshold needs to be added by the second adjustment amount when the trigger sub-condition is that a certain parameter is greater than the trigger threshold; and the second adjustment amount needs to be subtracted from the trigger threshold when the trigger sub-condition is that a certain parameter is less than the trigger threshold. It should be noted that the second adjustment amounts for adjusting respective trigger thresholds can be the same or different, and the first adjustment amount and the second adjustment amount can be the same or different.

As an optional embodiment, after the original trigger condition is adjusted to the second trigger condition, the method also includes: whether the KickDown is triggered is determined; and the second trigger condition is adjusted to the original trigger condition when the KickDown is triggered.

As another optional embodiment, after the original trigger condition is adjusted to the second trigger condition, the method also includes: the second trigger condition is adjusted to the original trigger condition when the wheel loader is powered off.

Figure 2:
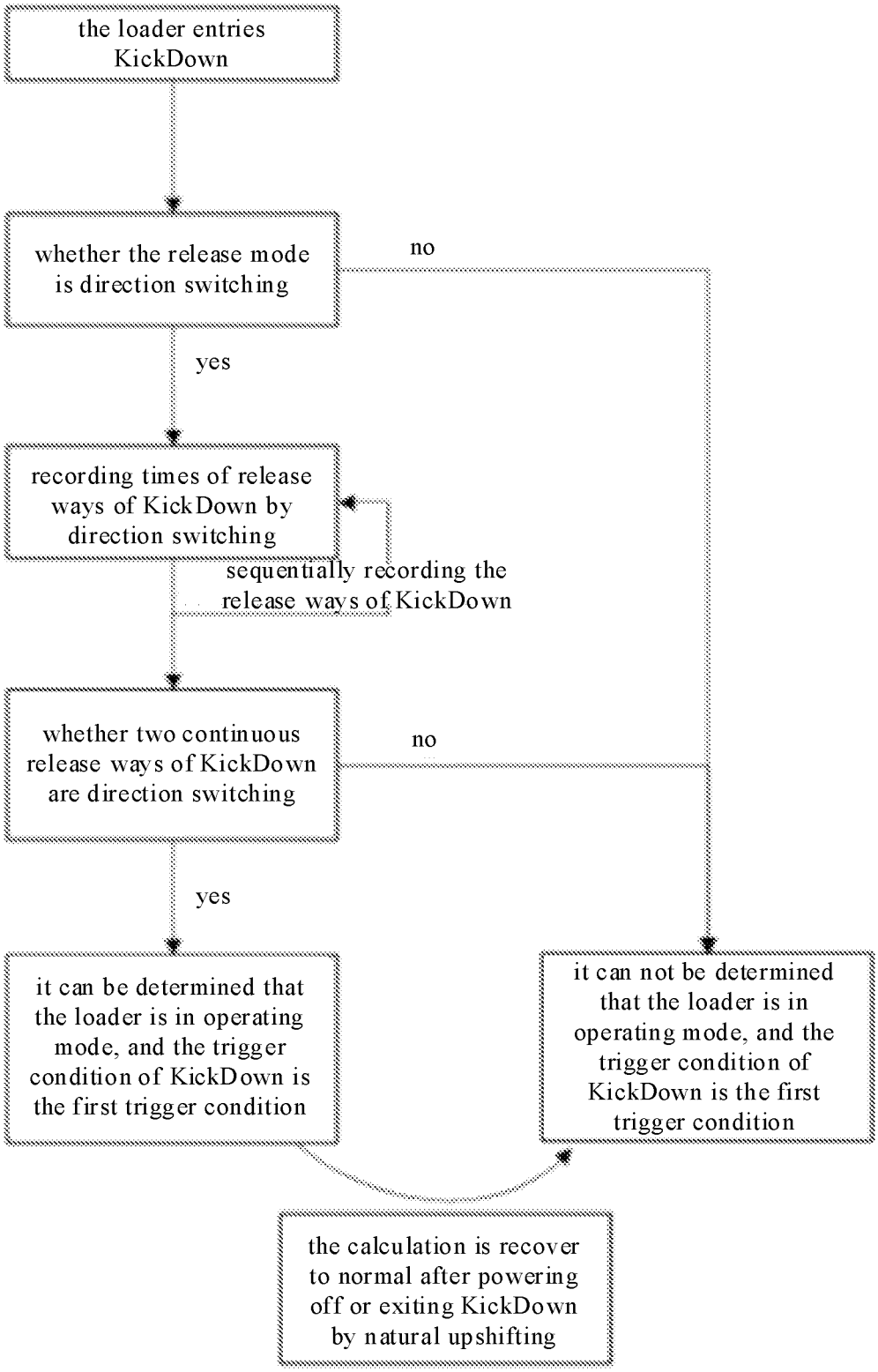
FIG. 2 is a flow diagram of a first example of the method for controlling the wheel loader according to the embodiment 1 of the present application.

In order to describe the method for controlling the wheel loader provided by the embodiment 1 of the present application in more detail, there are provided two examples as follows. FIG. 2 is a flow diagram of a first example of the method for controlling the wheel loader according to the embodiment 1 of the present application. As shown in FIG. 2, whether the loader has entered the operating mode of loading/unloading materials needs to be determined firstly according to the release way of triggered KickDown, and if KickDown is released by switching direction for two continuous times, it can be determined that the loader is in the operating mode, for example, the loader is in a working cycle of loading materials, switching directions, unloading materials, and it can be determined that the loader is in the operating mode until that the natural shift line rises two gears or the vehicle is powered off. In the operating mode, the trigger condition of KickDown is the first trigger condition, which is easier to trigger KickDown.

Figure 3:
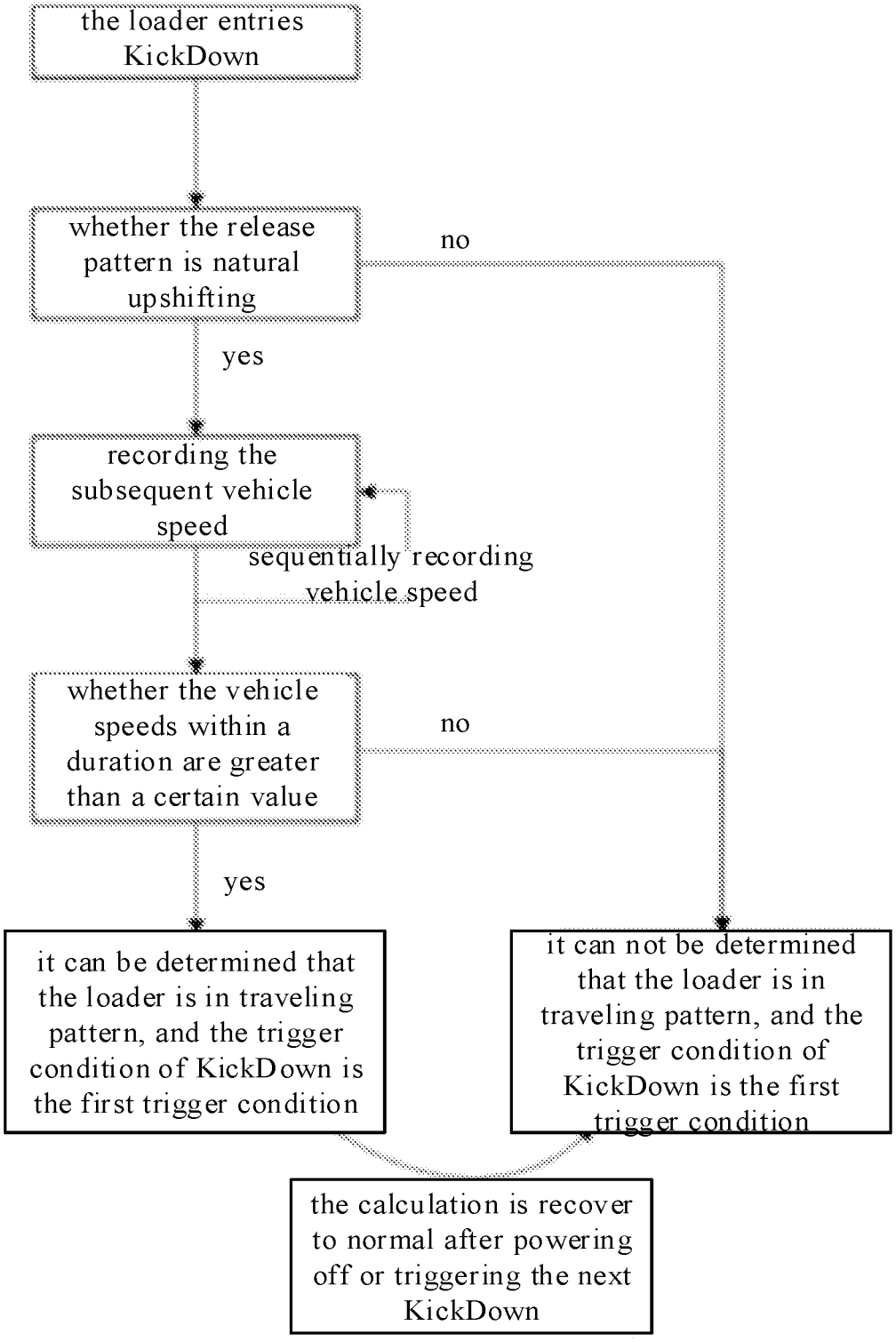
FIG. 3 is a flow diagram of a second example of the method for controlling the wheel loader according to the embodiment 1 of the present application.

FIG. 3 is a flow diagram of a second example of the method for controlling the wheel loader according to the embodiment 1 of the present application. As shown in FIG. 3, whether the loader has entered the traveling mode rather the operating mode needs to be determined firstly according to the release way of triggered KickDown. When KickDown is released by naturally upshifting two gears, it can be determined that the loader exits the operating mode. When the vehicle speed exceeds a certain value and can be maintained for a calibrated time, it can be determined that the loader has entered the traveling pattern until the next KickDown is triggered or the vehicle is powered off. In the traveling pattern, the trigger condition of KickDown is the second trigger condition, which is harder to trigger KickDown to avoid false triggering.

Embodiment 2

Figure 4:
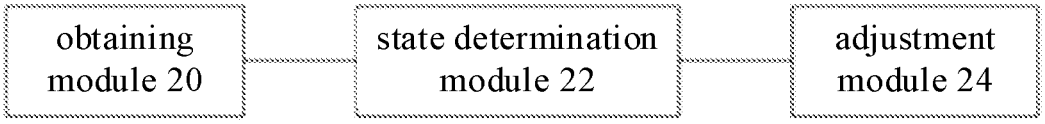
FIG. 4 is a structural diagram of a device for controlling a wheel loader according to an embodiment 2 of the present application.

Corresponding to the embodiment 1 of the present application, embodiment 2 of the present application provides a device for controlling a wheel loader. FIG. 4 is a structural diagram of the device for controlling the wheel loader according to the embodiment 2 of the present application. As shown in FIG. 4, the device for controlling the wheel loader provided by embodiment 2 of the present application includes an obtaining module 20, a state determination module 22 and an adjustment module 24.

In an embodiment, the obtaining module 20 is used to obtain a release way of KickDown of a wheel loader; the state determination module 22 is used to determine a current state of the wheel loader based on the release way of KickDown; and the adjustment module 24 is used to adjust an original trigger condition to a first trigger condition when the current state of the wheel loader is working state, where the first trigger condition is easier to be triggered than the original trigger condition, and adjust the original trigger condition to a second trigger condition when the current state of the wheel loader is traveling state, where the second trigger condition is harder to be triggered than the original trigger condition.

The specific details of the wheel loader can be understood according to the corresponding description and effect in the embodiments shown in FIGS. 1 to 3, and will not be repeated here.

Embodiment 3

An embodiment of the present application provides a wheel loader, which can include a processor and a memory, where the processor and the memory can be connected through a bus or other ways.

The processor can be a Central Processing Unit (CPU). The processor can also be other general processor, Digital Signal Processor (DSP), Application Specific Integrated Circuit (ASIC), Field-Programmable Gate Array (FPGA) or other chips, such as programmable logic components, discrete gates or transistor logic components and discrete hardware components, or a combination of the above types of chips.

As a non-transient computer-readable storage medium, memory can be used to store non-transient software programs, non-transient computer executable programs and modules, such as program instructions/modules corresponding to the method for controlling the wheel loader provided by the embodiments of the present application, such as the obtaining module 20, state determination module 22 and adjustment module 24 shown in FIG. 4. The processor executes various function applications and data processing of the processor, that is, implements the method for controlling the wheel loader in the above method embodiments, by executing the non-transient software programs, instructions and modules stored in the memory.

The memory may include a program storage and a data storage, where the program storage may store an operating system, an application program required by at least one function. The data storage may store the data created by the processor. In addition, the memory may include high-speed random access memory, and may also include non-transient memory, such as at least one disk storage component, flash memory component, or other non-transient solid-state storage components. In some embodiments, the memory may optionally include a memory remotely set relative to the processor, which may be connected to the processor via a network. Examples of the above network include but are not limited to the internet, enterprise intranet, local area network, mobile communication network and their combinations.

One or more modules are stored in the memory, and when executed by the processor, perform the methods for controlling the wheel loader provided by the embodiments shown in FIG. 1 to FIG. 3.

The specific details of the above wheel loader can be understood according to the corresponding description and effect in the embodiments shown in FIG. 1 to FIG. 4, and will not be repeated here.

Those skilled in the art can understand that the realization of all or part of the processes in the methods provided by the above embodiments can be completed by instructing the relevant hardware through a computer program. The program can be stored in a computer readable storage medium. When the program is executed, it can include the processes of the above method embodiments. The storage medium can be magnetic disc, optical disc, Read-Only Memory (ROM), Random Access Memory (RAM), Flash Memory, Hard Disk Drive (HDD) or Solid State Drive (SSD), etc. The storage medium may also include a combination of the above types of memories.

Although the embodiments of the present application has been described with reference to the accompanying drawings, those of ordinary skill in the art should can make various modifications and variations without departing from the scope of the present application, and such modifications and variations fall within the scope defined by the appended claims.

What is claimed is:

1. A method for controlling a wheel loader in which an original trigger condition of KickDown is preset, comprising:

obtaining a release way of KickDown of the wheel loader;

determining a current state of the wheel loader based on the release way of KickDown;

adjusting the original trigger condition to a first trigger condition when the current state of the wheel loader is a working state, wherein the original trigger condition comprises one or more trigger sub-conditions, and the trigger sub-condition has a corresponding trigger threshold; the adjusting the original trigger condition to the first trigger condition comprises adjusting one or more trigger thresholds by a corresponding first adjustment amount;

sequentially obtaining the release way of KickDown;

maintaining the first trigger condition when the release way of KickDown is to switch the traveling direction of the wheel loader;

adjusting the first trigger condition to the original trigger condition when the release way of KickDown is natural upshifting, determining when a trigger condition of KickDown is satisfied, and triggering KickDown when the trigger condition is satisfied.

2. The method for controlling the wheel loader according to claim 1, further comprising:

adjusting the original trigger condition to a second trigger condition when the current state of the wheel loader is a traveling state, wherein the original trigger condition comprises one or more trigger sub-conditions, and the trigger sub-condition has a corresponding trigger threshold; the adjusting the original trigger condition to the second trigger condition comprises adjusting one or more trigger thresholds by a corresponding second adjustment amount.

3. The method for controlling the wheel loader according to claim 1, wherein the determining the current state of the wheel loader based on the release way of KickDown comprises:

determining that the current state of the wheel loader is the working state when the current release way of KickDown is to switch a traveling direction of the wheel loader; or determining that the current state of the wheel loader is the working state when multiple continuous release ways of KickDown are to switch the traveling direction of the wheel loader.

4. The method for controlling the wheel loader according to claim 2, wherein the determining the current state of the wheel loader based on the release way of KickDown comprises:

determining that the current state of the wheel loader is the traveling state when the current release way of KickDown is natural upshifting; or sequentially determining whether all vehicle speeds of the wheel loader belong to a preset first range during a preset first duration when the current release way of KickDown is the natural upshifting, and determining that the current state of the wheel loader is the traveling state when all the vehicle speeds of the wheel loader belong to the preset first range during the preset first duration.

5. The method for controlling the wheel loader according to claim 2, after adjusting the original trigger condition to the second trigger condition, further comprising:

determining whether KickDown is triggered; and adjusting the second trigger condition to the original trigger condition when KickDown is triggered.

6. A device for controlling a wheel loader in which an original trigger condition of KickDown is preset, comprising:

an obtaining module configured to obtain a release way of KickDown of a wheel loader;

a state determination module configured to determine a current state of the wheel loader based on the release way of KickDown;

an adjustment module configured to adjust the original trigger condition to a first trigger condition when the current state of the wheel loader is a working state, wherein the original trigger condition comprises one or more trigger sub-conditions, and the trigger sub-condition has a corresponding trigger threshold; the adjusting the original trigger condition to the first trigger condition comprises adjusting one or more trigger thresholds by a corresponding first adjustment amount;

the obtaining module is further used to sequentially obtain the release way of KickDown;

the adjustment module is further used to maintain the first trigger condition when the release way of KickDown is to switch the traveling direction of the wheel loader;

adjust the first trigger condition to the original trigger condition when the release way of KickDown is natural upshifting, and a processor configured to determine when a trigger condition of KickDown is satisfied and trigger KickDown when the trigger condition is satisfied.

7. A wheel loader, comprising:

a processor; and a memory communicated with the processor storing computer instructions, wherein the computer instructions, when executed by the processor, perform the method for controlling the wheel loader according to claim 1.

8. A non-transitory computer-readable storage medium storing computer instructions for enabling the computer to execute the method for controlling the wheel loader according to claim 1.

* * * * *